US007146911B2

(12) United States Patent
Omoto et al.

(10) Patent No.: US 7,146,911 B2
(45) Date of Patent: Dec. 12, 2006

(54) IMAGE RECORDER

(75) Inventors: Arifumi Omoto, Kyoto (JP); Keisuke Hirayama, Kyoto (JP); Takayuki Mitsushima, Kyoto (JP); Masahiro Nakajima, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 11/200,137

(22) Filed: Aug. 10, 2005

(65) Prior Publication Data

US 2006/0038874 A1 Feb. 23, 2006

(30) Foreign Application Priority Data

Aug. 20, 2004 (JP) ..... 2004-240778

(51) Int. Cl.
*B41F 27/12* (2006.01)

(52) U.S. Cl. ..... 101/485; 101/477; 101/481

(58) Field of Classification Search ..... 101/477, 101/485, 481
See application file for complete search history.

(56) References Cited

U.S. PATENT DOCUMENTS 6,412,413 B1 * 7/2002 Tice et al. ..... 101/409
6,712,003 B1 3/2004 Hashiguchi
2003/0127004 A1 * 7/2003 Kitawaki et al. ..... 101/382.1

FOREIGN PATENT DOCUMENTS

JP 2000-056482 A 2/2000

* cited by examiner

*Primary Examiner*—Judy Nguyen
*Assistant Examiner*—Joshua Zimmerman
(74) *Attorney, Agent, or Firm*—McDermott Will & Emery LLP

(57) ABSTRACT

Positioning of a printing plate in an image recorder is performed by the same method used for punching positioning holes for printing press in the printing plate. Specifically, the positioning for image recording is performed with reference to an edge of the printing plate on the same side as the edge of the printing plate used as a reference for punching the positioning holes for printing press. When the positioning for punching the positioning holes for printing press is performed with reference to the central position of the printing plate, the central position of the printing plate is detected based on a measured width of the printing plate, and the positioning for image recording is carried out with reference to the central position. Consequently, an image recorded on the printing plate by the image recorder and the positioning holes for printing press in the printing plate always have the same positional relationship.

5 Claims, 12 Drawing Sheets

IMAGE RECORDER

BACKGROUND OF THE INVENTION

1. Field of the Invention

The present invention relates to an image recorder for directing a light beam modulated in accordance with an image signal onto a printing plate to record an image directly on the printing plate. More particularly, the invention relates to a technique for improving the precision of the positional relationship between an image recorded on a printing plate and positioning holes serving as a reference for mounting the printing plate on a plate cylinder of a printing press or positioning holes serving as a reference for mounting the printing plate on a bending machine, a puncher or the like (these positioning holes hereinafter will generically be referred to as positioning holes for printing press).

2. Description of the Background Art

Image recorders for directing a light beam modulated in accordance with an image signal onto a printing plate to directly record an image on the printing plate have conventionally been known.

An image recorder includes a punch unit and a recording drum on which a printing plate is mounted. First, the image recorder punches positioning holes serving as a reference for positioning the printing plate on the recording drum (hereinafter referred to as positioning holes for recording drum) and positioning holes for printing press at the same time in the punch unit. Thereafter, the image recorder makes the positioning holes for recording drum fit over positioning pins provided upright on the recording drum, to accurately position the printing plate on the recording drum. In this state, the image recorder directs a light beam from a recording head while rotating the recording drum at high speeds, thereby recording a two-dimensional image on the printing plate fixed on the recording drum.

In the case of recording a plurality of color component images for constituting a color image on a plurality of printing plates, the positional relationship between a color component image recorded on each printing plate and positioning holes for printing press needs to coincide precisely in the respective printing plates.

The above-described image recorder accurately positions the printing plate on the outer peripheral surface of the recording drum with reference to the positioning pins. The positioning holes for recording drum to be fitted over the positioning pins and the positioning holes for printing press are punched at the same time. Therefore, the positional relationship between these positioning holes is accurate. Further, the recording head has such a positional accuracy that an image is recorded accurately in a predetermined position on the recording drum. Therefore, an image recorded on the printing plate by the recording head and the positioning holes for printing press always have a sufficient degree of positional accuracy.

As described above, the above image recorder achieves a sufficient degree of positional accuracy between the positioning holes for printing press and a recorded image since the positioning holes for printing press are punched at the same time as the positioning holes for recording drum. However, these positioning holes are not always punched at the same time. Alternatively, the printing press may be fixed on the recording drum without punching any positioning holes for recording drum. In such cases, a sufficient degree of positional accuracy may not be ensured between a recorded image on the printing plate and the positioning holes for printing press.

SUMMARY OF THE INVENTION

The present invention is directed to an image recorder.

According to an aspect of the invention, the image recorder comprises: a transport element for transporting a rectangular printing plate in a first direction; a positioning element for moving said printing plate in a second direction perpendicular to said first direction, thereby positioning said printing plate in said second direction; and an image recording element for directing a light beam onto said printing plate positioned in said second direction by said positioning element, thereby recording an image on said printing plate. The positioning element selectively executes one of making one edge of two edges of said printing plate almost parallel to said first direction reach a first reference edge position and making the other edge of said two edges reach a second reference edge position, depending on a positioning method used for punching positioning holes for printing press in said printing plate.

According to another aspect of the invention, the image recorder comprises: a transport element for transporting a rectangular printing plate in a first direction; a positioning element for moving said printing plate in a second direction perpendicular to said first direction, thereby positioning said printing plate in said second direction; and an image recording element for directing a light beam onto said printing plate positioned in said second direction by said positioning element, thereby recording an image on said printing plate. The positioning element selectively executes one of making a reference edge of said printing plate almost parallel to said first direction reach a predetermined reference edge position and making a central position of said printing plate in said second direction reach a predetermined reference central position, depending on a positioning method used for punching positioning holes for printing press in said printing plate.

The positioning for recording an image on the printing plate and the positioning for punching positioning holes for printing press in the printing plate can be carried out by the same method. Therefore, even in the case of recording images on a plurality of printing plates, the positional relationship between a recorded image on each printing plate and positioning holes can be improved in accuracy.

The present invention is also directed to a method of recording an image on a rectangular printing plate.

It is therefore an object of the present invention to provide an image recorder and a method of recording an image, capable of achieving a sufficient degree of positional accuracy between a recorded image and positioning holes for printing press in either case where positioning holes for printing press and positioning holes for recording drum are not punched at the same time or where a printing plate is fixed on a recording drum without punching any positioning holes for recording drum.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
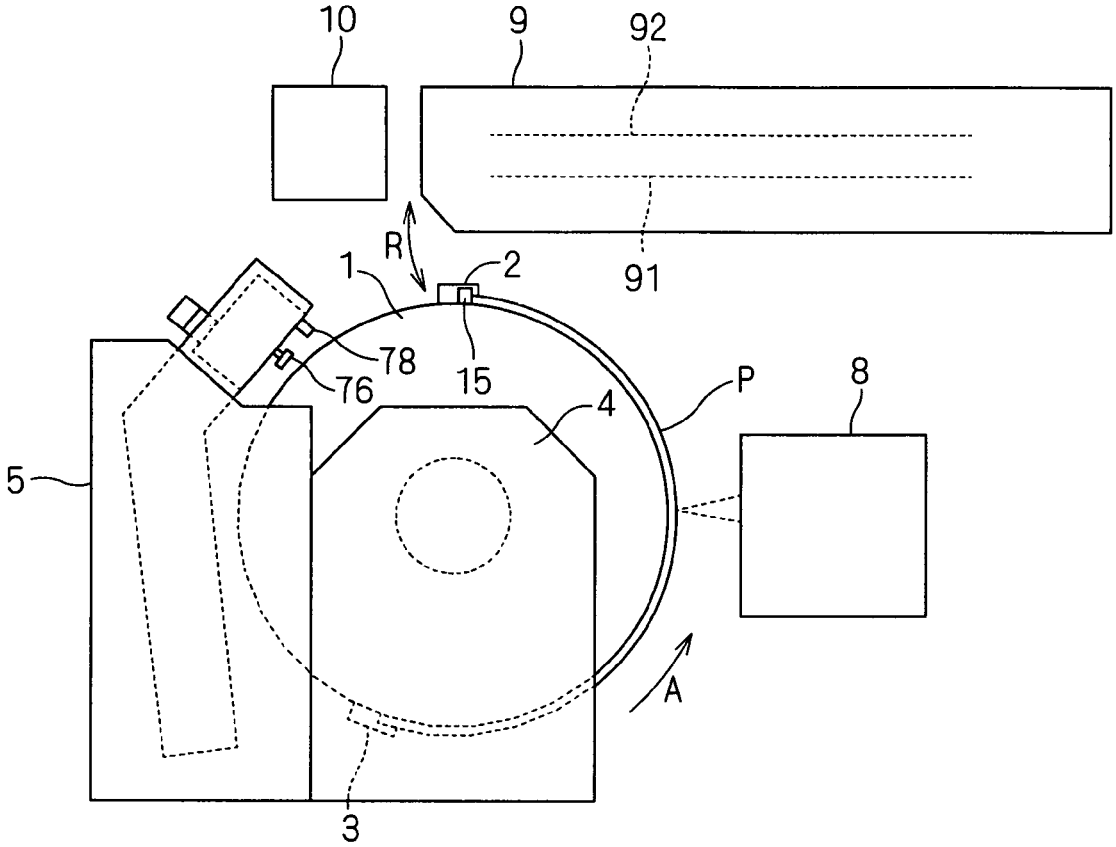
FIG. 1 is a schematic side view illustrating an image recorder to which the present invention is applied.

FIG. 1 is a schematic side view illustrating an image recorder according to a preferred embodiment of the present invention.

The image recorder includes a cylindrical recording drum 1 attached to a base 5. The recording drum 1 is rotatably driven by a rotation driving device 4 about a rotary axis along an arrow A (in the main scanning direction). A printing plate P made of an aluminum base and an image-recording layer formed thereon is mounted on the outer peripheral surface of the recording drum 1. The printing plate P is fixed on the outer peripheral surface of the recording drum 1 with a leading edge clamped by a plurality of leading edge clamps 2 and the other edge clamped by a plurality of trailing edge clamps 3.

For causing the leading edge clamps 2 to clamp the leading edge of the printing plate P, the leading edge clamps 2 are each pressed by a pin not shown into a released state capable of accepting the leading edge of the printing plate P.

The trailing edge clamps 3 are each normally held by a holding pin 76. After the leading edge of the printing plate P is clamped by the leading edge clamps 2, the trailing edge clamps 3 are each moved from the holding pin 76 to the recording drum 1 to clamp the trailing edge of the printing plate P on the recording drum 1.

For demounting the printing plate P from the recording drum 1 after image recording, the leading edge clamps 2 are each pressed by a release pin 78, so that the leading edge of the printing plate P is released from the leading edge clamps 2.

An image is recorded on the printing plate P fixed on the outer peripheral surface of the recording drum 1 by a recording head 8. The recording head 8 directs a laser beam in response to an image signal while moving along the rotary axis of the recording drum 1 (i.e., in a direction perpendicular to the sheet of drawing or a subscanning direction) in synchronization with the rotation of the recording drum 1.

A transport unit 9 is provided above the recording drum 1 in a swingable manner along arrows R. The transport unit 9 has a first transport path 91 for loading the printing plate P and a second transport path 92 for unloading the printing plate P. For loading the printing plate P, the printing plate P is fed to the recording drum 1 along the first transport path 91. For unloading the printing plate P, the printing plate P demounted from the recording drum 1 is unloaded to the outside along the transport path 92.

Transport Unit 9

Figure 2:
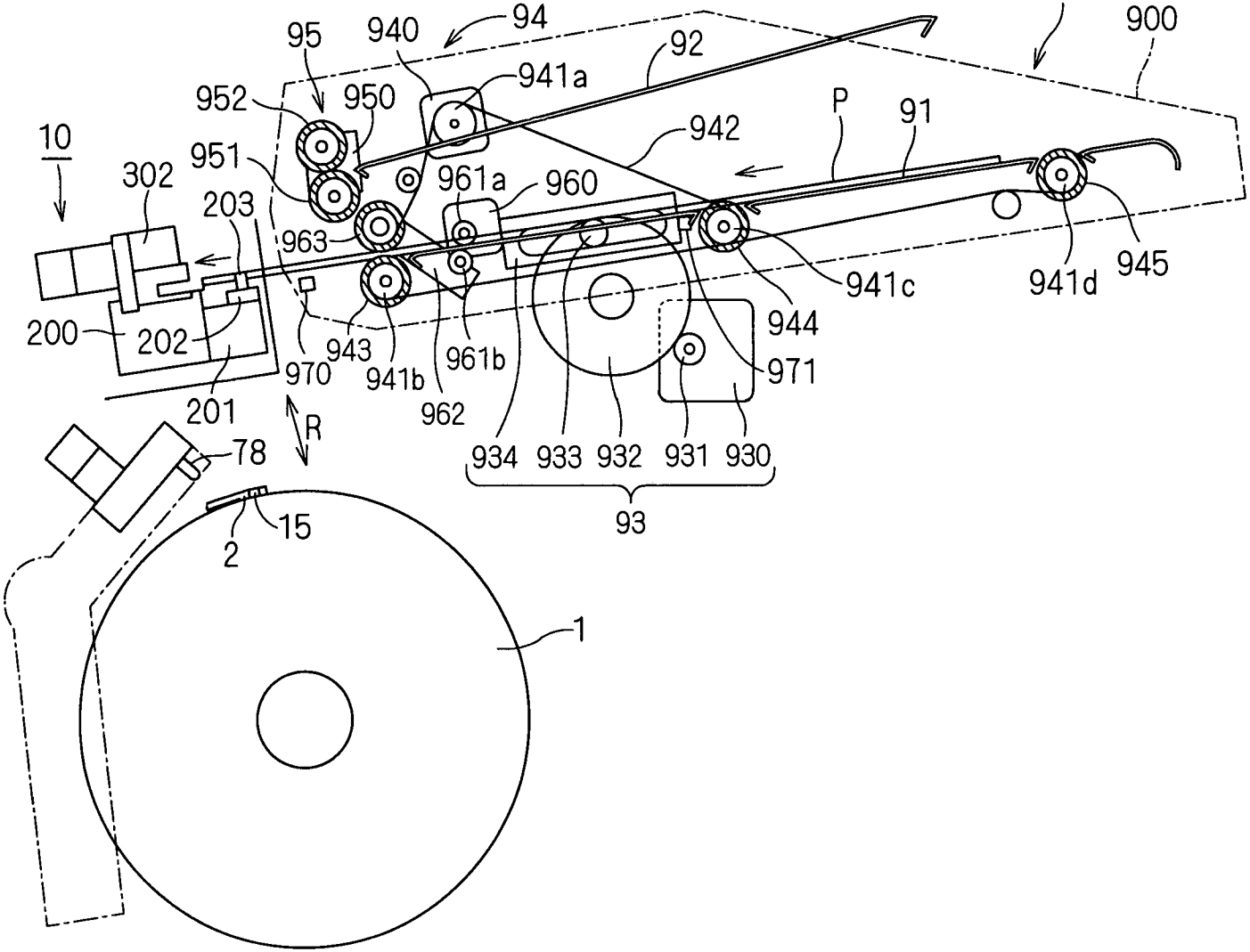
FIG. 2 is a side view illustrating the construction of a transport unit in the image recorder shown in FIG. 1.

FIG. 2 is a side view illustrating the construction of the transport unit 9. The transport unit 9 includes a unit body 900 having therein the first transport path 91, the second transport path 92, a transport path switching mechanism 93, a first transport mechanism 94 and a second transport mechanism 95.

The transport path switching mechanism 93 is made up of a transport path switching motor 930, a gear 931, a cam gear 932, a cam follower 933 and a cam follower guide 934. The gear 931 is attached to the transport path switching motor 930. The cam gear 932 is in engagement with the gear 931, and the cam follower 933 is fixed to the cam gear 932. The cam follower 933 is in engagement with the cam follower guide 934. The cam follower guide 934 is fixed to the unit body 900, and the unit body 900 is supported mainly at its rear portion in a swingable manner by a predetermined support member (not shown).

As the transport path switching motor 930 rotates, the cam gear 932 rotates via the gear 931, and the cam follower guide 934 moves up and down by the action of the cam follower 933 fixed to the cam gear 932. Accordingly, the transport unit 9 swings along the arrows R.

The first transport mechanism 94 is made up of a transport roller driving motor 940, pulleys 941*a*, 941*b*, 941*c*, 941*d*, a belt 942, and three transport rollers 943, 944 and 945. The pulley 941*a* is attached to the transport roller driving motor 940, and the pulleys 941*b*, 941*c* and 941*d* are attached to the transport rollers 943, 944 and 945, respectively. The rotational power of the transport roller driving motor 940 is transmitted to the pulleys 941*b*, 941*c* and 941*d* from the pulley 941*a* via the belt 942. Accordingly, the transport rollers 943, 944 and 945 rotate.

The second transport mechanism 95 is made up of a transport roller driving motor 950 and transport rollers 951 and 952. The transport rollers 951 and 952 are rotatably driven by the transport roller driving motor 950.

Further, a nip roller 963 is provided in close contact with the transport roller 943 on the first transport path 91. The nip roller 963 is supported in a swingable manner by a swing member 962. A gear 961*a* is attached to a nip roller driving motor 960. The gear 961*a* is in engagement with a gear 961*b* attached to the swing member 962. As the nip roller driving motor 960 rotates, the swing member 962 swings by the action of the gears 961*a* and 961*b* to bring the nip roller 963 into contact with the transport roller 943. Accordingly, the printing plate P is held between the transport roller 943 and nip roller 963.

The first transport roller 943 and nip roller 963 are arranged such that their rotary axes extend parallel to the rotary axis of the recording drum 1 in plan view. Accordingly, the first transport roller 943 and nip roller 963 can transport the printing plate P in a direction perpendicular to the rotary axis of the recording drum 1.

A printing-plate leading-edge detection sensor 970 for detecting the leading edge of the printing plate P is provided at an end of the transport path 91, and a printing-plate trailing-edge detection sensor 971 for detecting the trailing edge of the printing plate P is provided at the center of the transport path 91.

Printing-Plate Side-to-Side Adjustment Unit 10

A printing-plate side-to-side adjustment unit 10 for positioning the printing plate P along the rotary axis of the recording drum 1 as well as punching positioning holes for printing press is provided at an end of the transport unit 9. The printing plate P is sent to the printing-plate side-to-side adjustment unit 10 via the first transport path 91 of the transport unit 9 prior to being fed to the recording drum 1, and is positioned along the rotary axis of the recording drum 1 (i.e., in a direction perpendicular to the direction in which the printing plate P is transported by the first transport roller 943 and nip roller 963). The positioning will be described later in detail. The printing-plate side-to-side adjustment unit 10 includes two pairs of punching blocks 301 and 302 for punching positioning holes for printing press. The unit 10 is capable of punching positioning holes for printing press in the printing plate P by using one pair of the two pairs of punching blocks 301 and 302. Thereafter, the printing plate P placed in position is fed to the recording drum 1 along the first transport path 91.

A pair of positioning pins 15 is provided on the outer peripheral surface of the recording drum 1. The printing plate P transported along the first transport path 91 comes into contact with the pair of positioning pins 15 at its leading edge, so that the printing plate P is positioned in a circumferential direction of the recording drum 1.

Figure 3A:
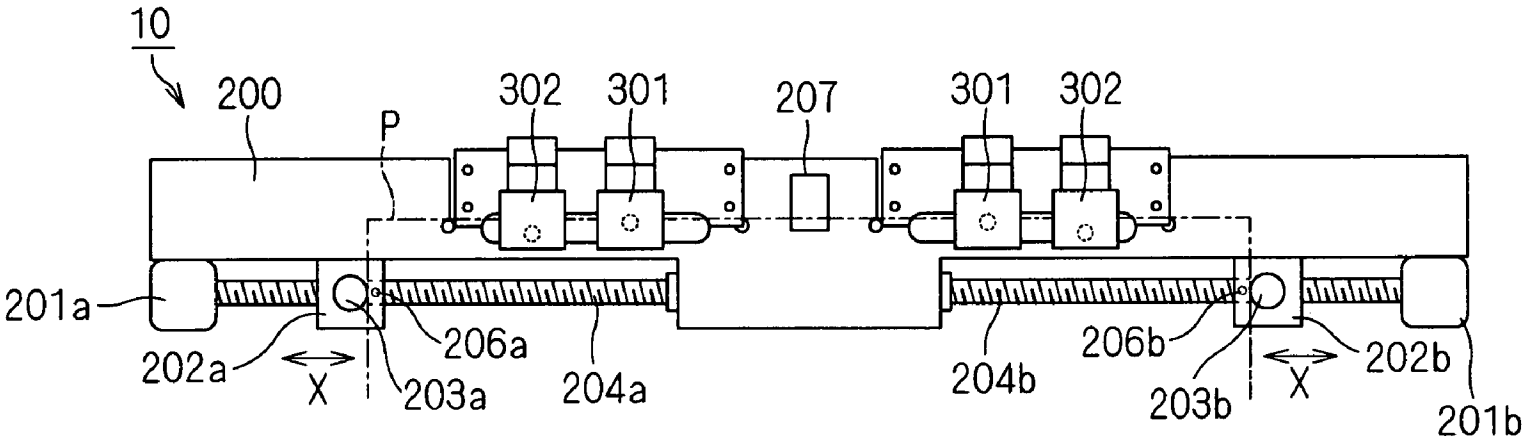
FIGS. 3A and 3B are a top view and a side view, respectively, illustrating a printing-plate side-to-side adjustment unit in the image recorder shown in FIG. 1.
Figure 3B:
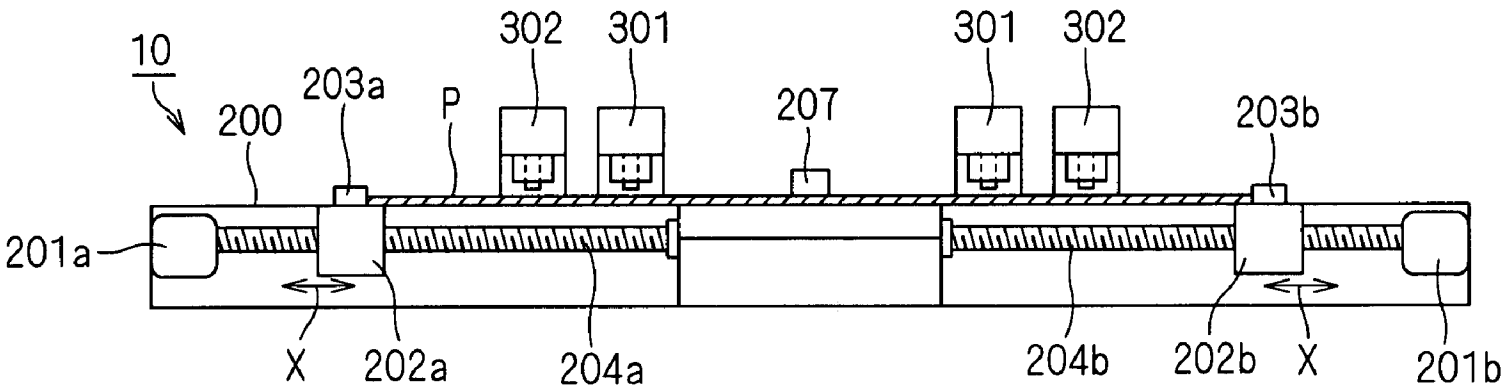

FIG. 3A is a top view illustrating the printing-plate side-to-side adjustment unit 10 of the image recorder to which the present invention is applied, and FIG. 3B is a side view thereof.

The printing-plate side-to-side adjustment unit 10 includes a base 200, first and second ball screws 204*a* and 204*b* provided in front of the base 200, a first side-to-side adjustment motor 201*a* for rotating the first ball screw 204*a*, a second side-to-side adjustment motor 201*b* for rotating the second ball screw 204*b*, a first side-to-side adjustment bearing 202*a* in threaded engagement with the first ball screw 204*a*, a second side-to-side adjustment bearing 202*b* in threaded engagement with the second ball screw 204*b* and a leading-edge detection sensor 207 provided on the top face of the base 200.

As constructed in this manner, the first and second side-to-side adjustment bearings 202*a* and 202*b* are movable individually along arrows X (in a direction perpendicular to the direction in which the printing plate P is transported).

Figure 4:
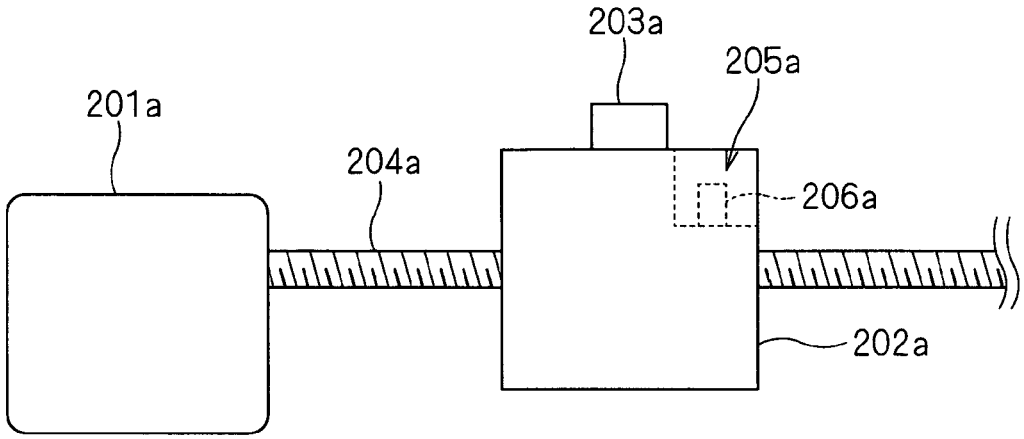
FIG. 4 is a side view illustrating a first side-to-side adjustment bearing.

FIG. 4 is a side view illustrating the first side-to-side adjustment bearing 202*a*. A cylindrical first abutment member 203*a* is fixed on the top face of the first side-to-side adjustment bearing 202*a*. A first recess 205*a* is also formed in the top face of the first side-to-side adjustment bearing 202*a*, and a first printing-plate detection sensor 206*a* for optically detecting that the printing plate P is positioned thereabove is arranged in the first recess 205*a*.

Figure 5:
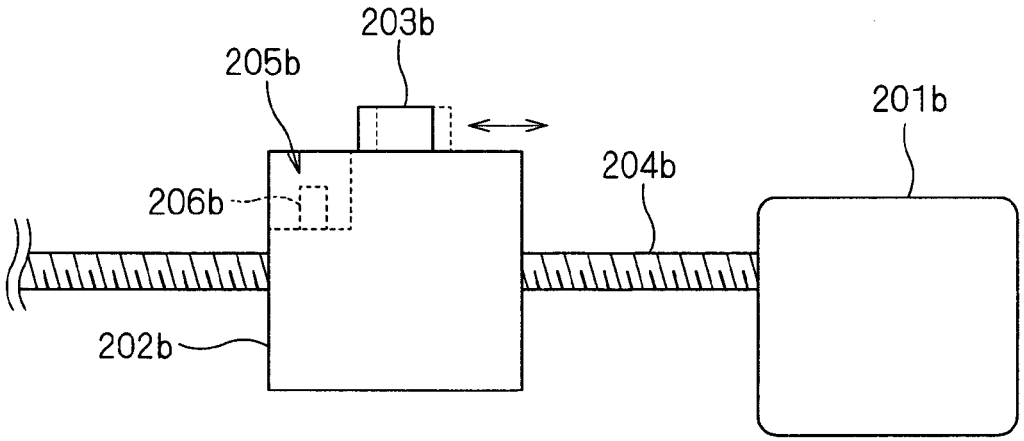
FIG. 5 is a side view illustrating a second side-to-side adjustment bearing.

FIG. 5 is a side view illustrating the second side-to-side adjustment bearing 202*b*. The second side-to-side adjustment bearing 202*b* is constructed similarly to the first side-to-side adjustment bearing 202*a*. More specifically, a cylindrical second abutment member 203*b* is provided on the top face of the second side-to-side adjustment bearing 202*b*. A second recess 205*b* is also formed in the top face of the second side-to-side adjustment bearing 202*b*, and a second printing-plate detection sensor 206*b* for optically detecting that the printing plate P is positioned thereabove is provided in the second recess 205*b*. The second abutment member 203*b* provided on the top face of the second side-to-side adjustment bearing 202*b* is slightly slidable in a direction in which the second ball screw 204*b* extends (along arrows shown in the drawing). The second abutment member 203*b* is urged by a spring not shown in a direction approaching the first abutment member 203*a*.

The image recorder can cope with the case of punching positioning holes for printing press by a punching device provided separately from the image recorder. That is, the method of positioning the printing plate in the image recorder may be changed in accordance with the positioning method of the separately-provided punching device.

Types of Positioning Methods

The printing-plate side-to-side adjustment unit 10 carries out positioning of the printing plate P by adjusting the central position. More specifically, the first and second side-to-side adjustment bearings 202*a* and 202*b* perform a side-to-side adjustment operation such that the center of the printing plate P in its widthwise direction coincides with the central position of the printing-plate side-to-side adjustment unit 10. The first side-to-side adjustment bearing 202*a* basically presses one edge (hereinafter referred to as a "home-side edge") of the printing plate P on the side of the first side-to-side adjustment motor 201*a* (hereinafter referred to as a "home side") such that the home-side edge is positioned away from the central position of the printing-plate side-to-side adjustment unit 10 toward the home side by half an entered width of the printing plate P. Similarly, the second side-to-side adjustment bearing 202*b* basically presses the other edge (hereinafter referred to as an "away-side edge") of the printing plate P on the side of the second side-to-side adjustment motor 201*b* (hereinafter referred to as an "away side") such that the away-side edge is positioned away from the central position of the printing-plate side-to-side adjustment unit 10 toward the away side by half the entered width of the printing plate P.

The printing plate P is cut out with predetermined standardized dimensions. The standardized dimensions of the printing plate P to be used are entered into the image recorder. However, the printing plate P slightly varies in width due to cutting errors or the like, so that the entered width of the printing plate P may not agree with a measured width. There are three methods of positioning a plurality of printing plates P to be used for overprinting a plurality of images, which will be described referring to FIGS. 6 to 8.

Figure 6:
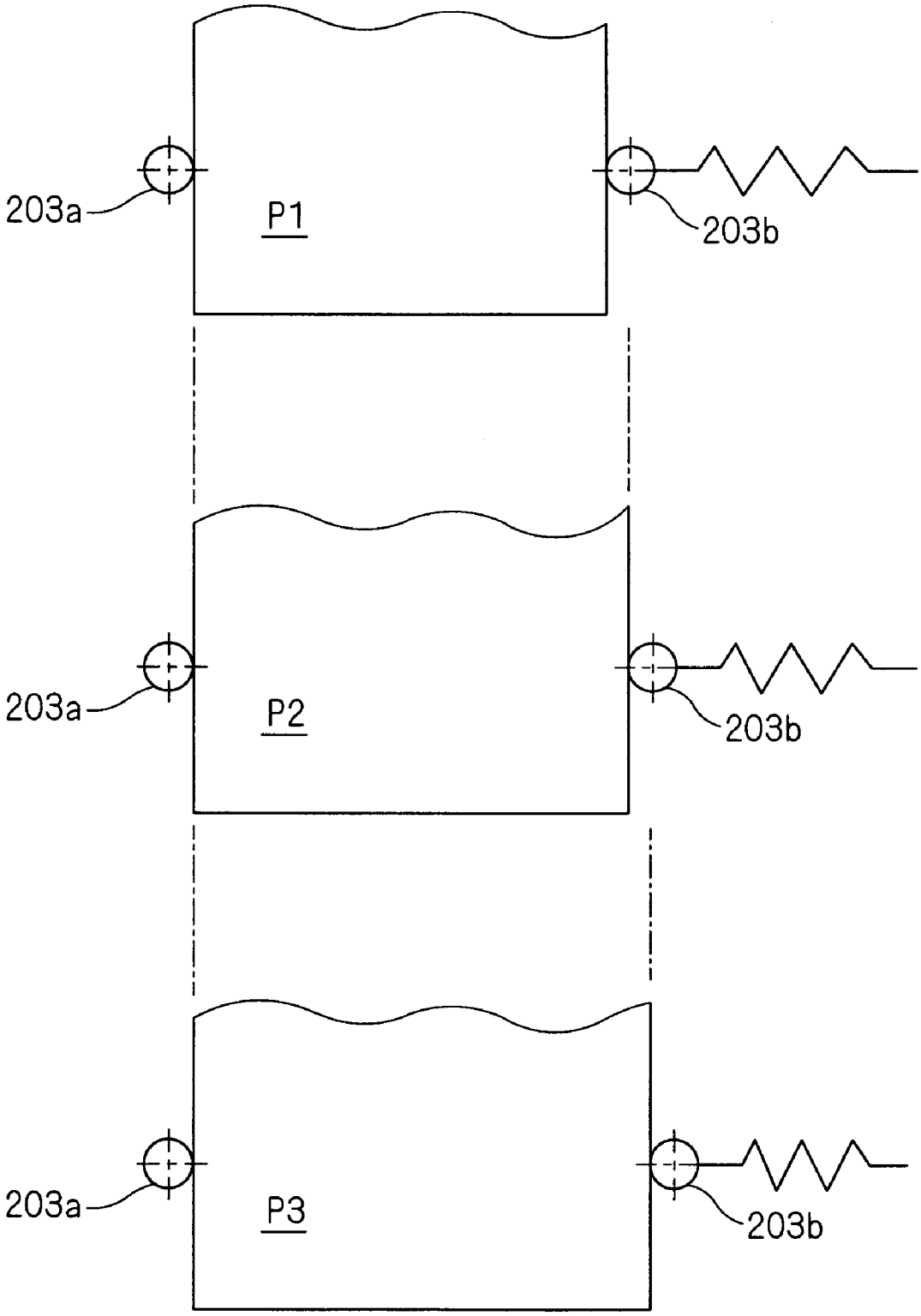
FIGS. 6 to 8 are explanatory views illustrating methods of positioning a printing plate by way of example.

The first method is to carry out positioning of the printing plate P with reference to the home-side edge thereof (hereinafter referred to as "home-side edge registration"). FIG. 6 is a schematic view illustrating the home-side edge registration. The positioning is carried out such that the home-side edges of a plurality of printing plates P1, P2 and P3 are in the same position even when the printing plates P1 to P3 have different widths.

Figure 7:
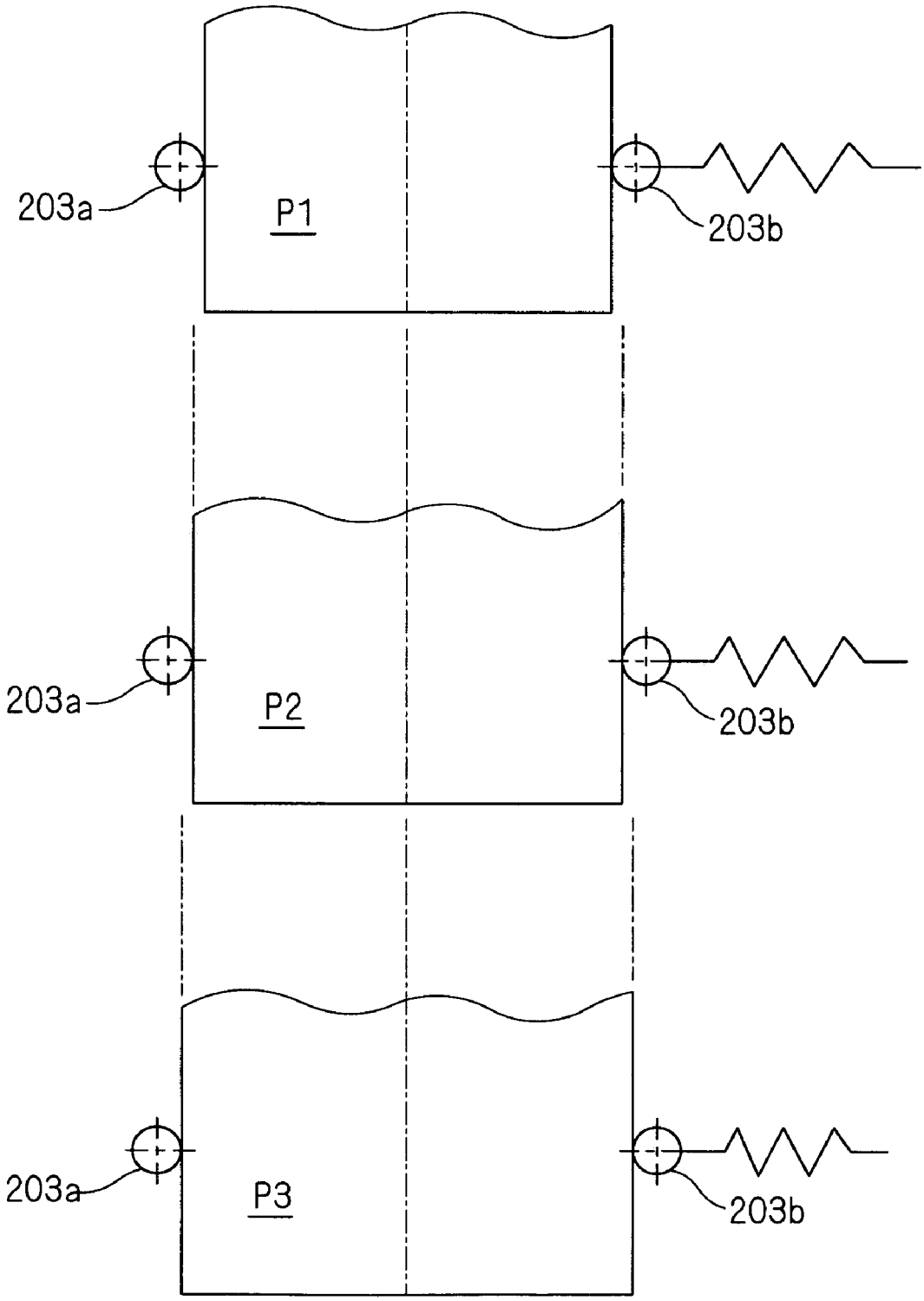

The second method is to carry out positioning of the printing plate P with reference to the center thereof (hereinafter referred to as "centering"). FIG. 7 is a schematic view illustrating the centering. In this case, the positioning is carried out such that the centers of the printing plates P1 to P3 are in the same position even when the printing plates P1 to P3 have different widths.

Figure 8:
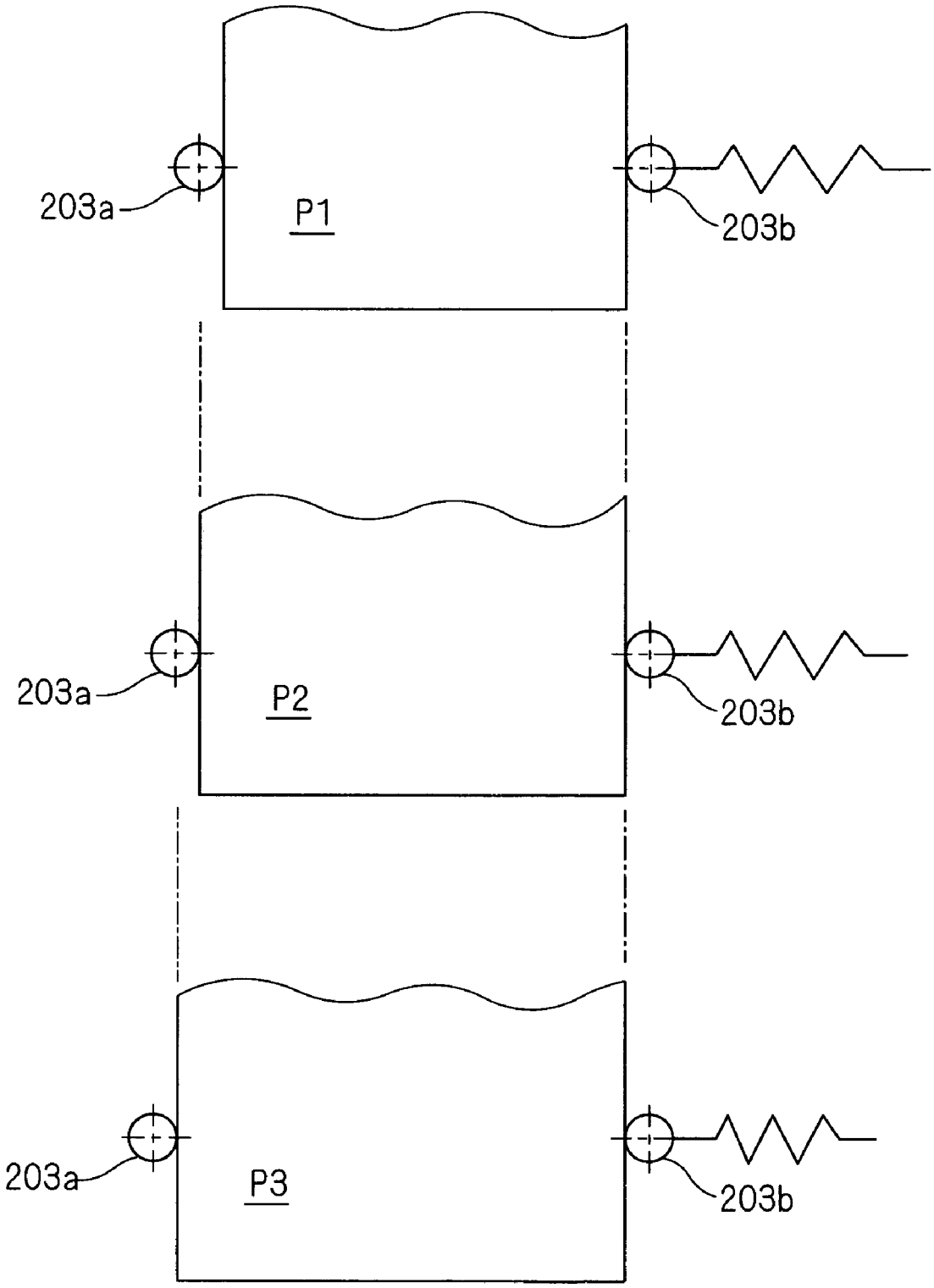

The third method is to carry out positioning of the printing plate P with reference to the away-side edge thereof (hereinafter referred to as "away-side edge registration). FIG. 8 is a schematic view illustrating the away-side edge registration. In this case, the positioning is carried out such that the away-side edges of the printing plates P1 to P3 are in the same position even when the printing plates P1 to P3 have different widths.

Schematic Views

FIGS. 9A to 9D are schematic views illustrating respective steps of successively executing image recording on the printing plate P and punching of positioning holes for printing press. FIGS. 10A to 10D are schematic views illustrating how image recording and punching of positioning holes for printing press are executed for each printing plate when the above operation is performed repeatedly on a plurality of printing plates.

Figure 9A:
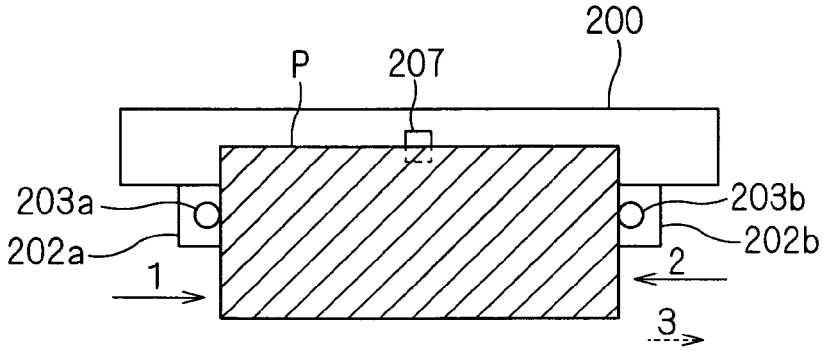
FIGS. 9A to 9D are schematic views illustrating steps of successively executing image recording on a printing plate and punching of positioning holes for printing press.

FIG. 9A shows the positioning of the printing plate P performed by the printing-plate side-to-side adjustment unit 10. The printing plate P is moved forward until its leading edge is detected by the leading-edge detection sensor 207. Then, the first side-to-side adjustment bearing 202*a* is shifted a predetermined distance along an arrow 1 shown in the drawing, so that the home-side edge is positioned by the first abutment member 203*a*. Next, the second side-to-side adjustment bearing 202*b* is shifted along an arrow 2 shown in the drawing, so that the away-side edge is positioned by the second abutment member 203*b*.

Figure 10A:
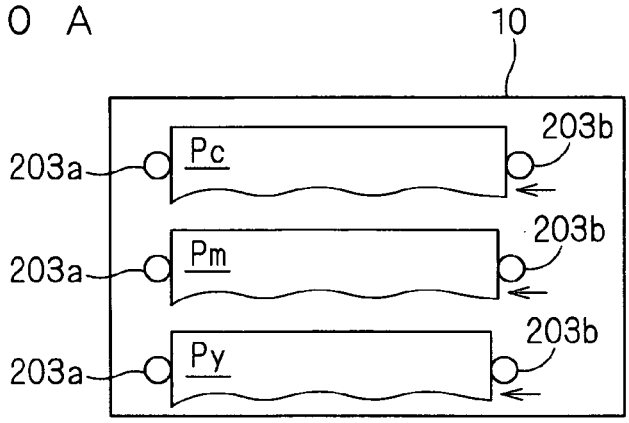
FIGS. 10A to 10D are schematic views illustrating how image recording and punching of positioning holes for printing press are executed for each printing plate when the operation shown in FIGS. 9A to 9D is performed repeatedly on a plurality of printing plates.

Since the home-side edge registration is employed here, the home-side edges of a plurality of printing plates Pc (on which the cyan component of an image is to be recorded), Pm (on which the magenta component of an image is to be recorded) and Py (on which the yellow component of an image is to be recorded) shall be in the same position in the printing-plate side-to-side adjustment unit 10 when the side-to-side adjustment operation is repeatedly performed on the printing plates Pc, Pm and Py as shown in FIG. 10A.

Figure 9B:
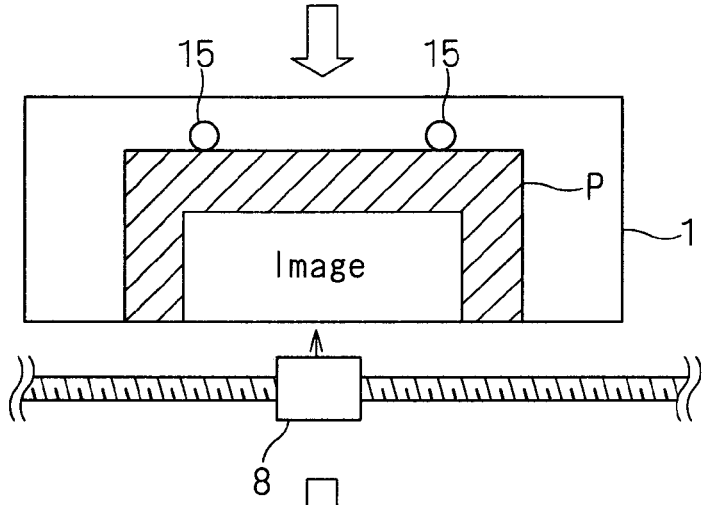

Next, the printing plate P is moved onto the recording drum 1, where image recording is performed by the recording head 8. FIG. 9B shows this stage.

Figure 10B:
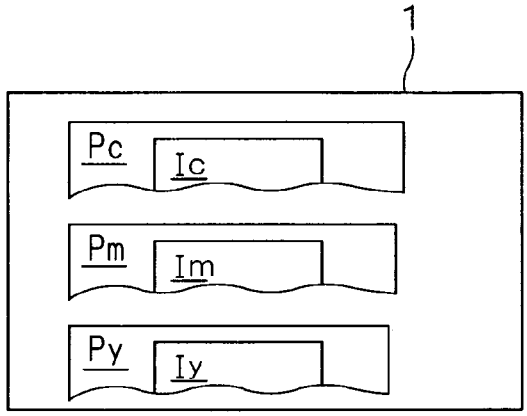

The first transport roller 943 and nip roller 963 of the image recorder can move the printing plate P back and forth accurately while keeping the inclination of the printing plate P. The printing plate P is therefore moved onto the recording drum 1 from the side-to-side adjustment unit 10 with the inclination of its leading edge relative to the rotary axis of the recording drum 1 being maintained. Accordingly, as shown in FIG. 10B, the printing plates Pc, Pm and Py are moved onto the recording drum 1 such that their home-side edges are in the same position on the outer peripheral surface of the recording drum 1. Next, color component images Ic, Im and Iy are recorded on the printing plates Pc, Pm and Py, respectively, by the recording head 8. The home-side edges of the respective printing plates Pc, Pm and Py a11 have the same positional relationship with the corresponding color component images Ic, Im and Iy.

Figure 9C:
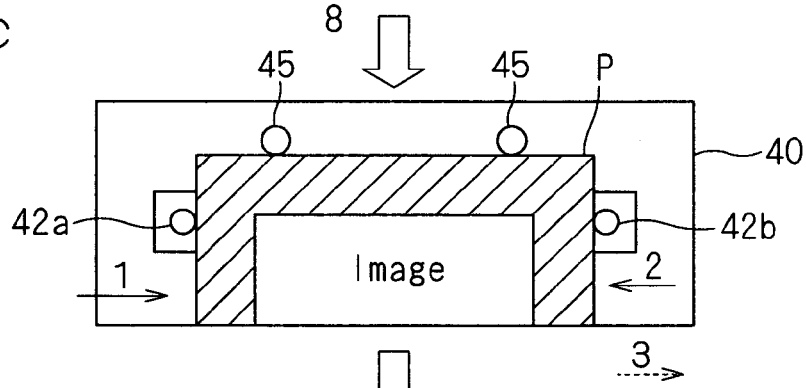

Next, the printing plate P is transported to a punching device 40 separately provided. FIG. 9C shows this stage. The punching device 40 shall also perform the home-side edge registration.

The leading edge of the printing plate P in the transport direction is positioned by a pair of positioning pins 45, and an abutment member 42*a* is then moved a predetermined distance along an arrow 1 shown in the drawing to position the home-side edge of the printing plate P. Next, an abutment member 42*b* is moved along an arrow 2. The abutment member 42*b* is slightly slidable similarly to the second abutment member 203*b* of the image recorder. Accordingly, width errors in printing plates P are smoothed out by the slight movement of the abutment member 42*b*.

Figure 10C:
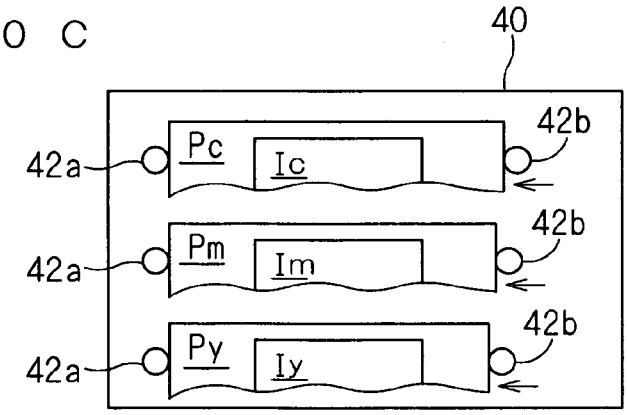

As shown in FIG. 10C, the plurality of printing plates Pc, Pm and Py are positioned and fixed on the punching device 40 such that their home-side edges are in the same position on the punching device 40.

Figure 9D:
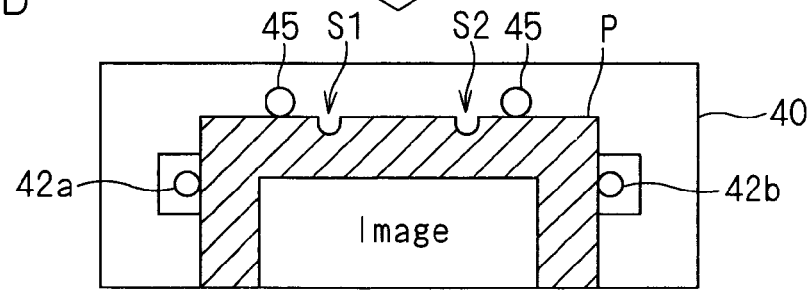
Figure 10D:
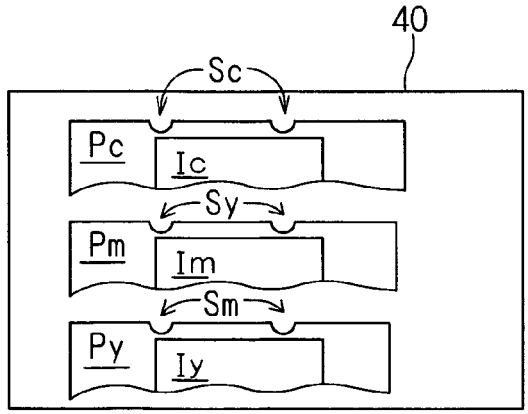

Next, two positioning holes S1 and S2 for printing press are punched at the leading edge of the printing plate P by a punch unit not shown but provided for the punching device 40 (FIG. 9D). Accordingly, as shown in FIG. 10D, positioning holes Sc, Sm and Sy for printing press punched on the respective printing plates Pc, Pm and Py a11 have the same positional relationship with the corresponding images Ic, Im and Iy.

COMPARATIVE EXAMPLE

In the above-described example, the image recorder and the separately-provided punching device employ the same positioning method. However, different methods may be employed in the image recorder and the punching device. In such a case, the positional relationship between a recorded image and positioning holes may not be the same in a11 printing plates.

Figure 11A:
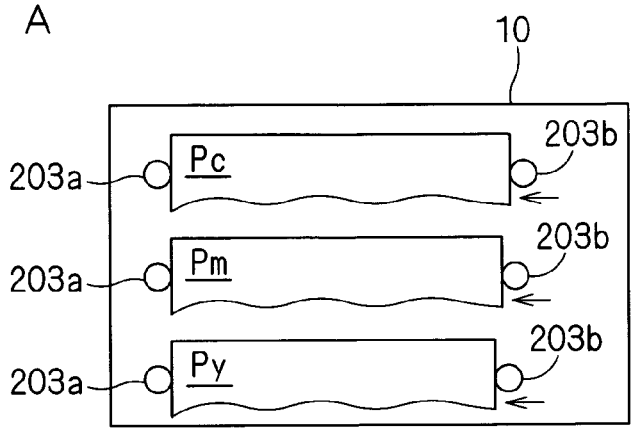
FIGS. 11A to 11D are explanatory views illustrating a problem which may occur when the operation shown in FIGS. 9A to 9D is performed repeatedly on a plurality of plates.
Figure 11B:
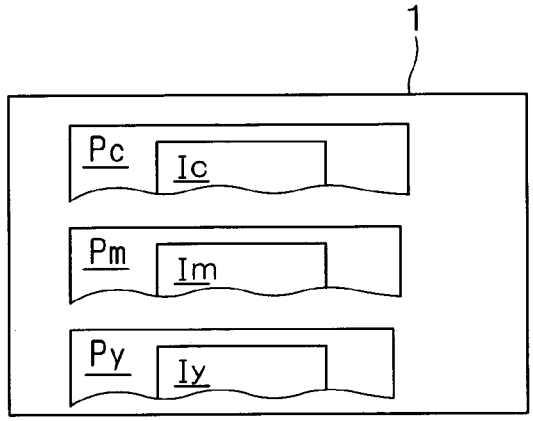
Figure 11C:
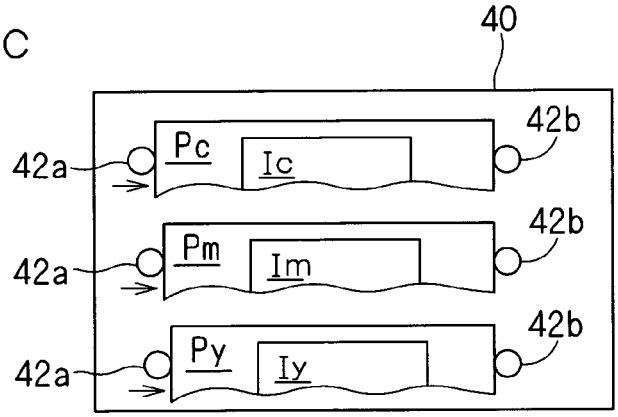
Figure 11D:
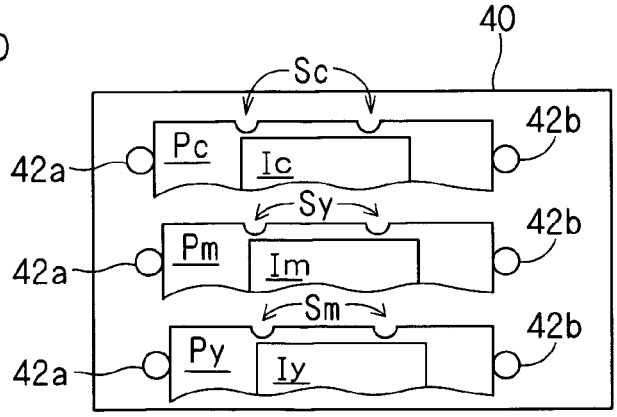

FIGS. 11A to 11D are schematic views illustrating the case where the image recorder employs the home-side edge registration while the punching device 40 separately provided employs the away-side edge registration. FIGS. 11A, 11B, 11C and 11D correspond to the stages shown in FIGS. 10A, 10B, 10C and 10D, respectively, and thus, repeated explanation is omitted here. In the case where the positioning for image recording and the positioning for punching positioning holes are not carried out by the same positioning method (FIGS. 11A and 11C) when the printing plates Pc, Pm and Py have different widths (FIG. 11A), the recorded images Ic, Im and Iy recorded on the printing plates Pc, Pm and Py, respectively, and the corresponding positioning holes Sc, Sm and Sy do not have the same positional relationship (FIG. 11D).

Process Flow

Figure 12:
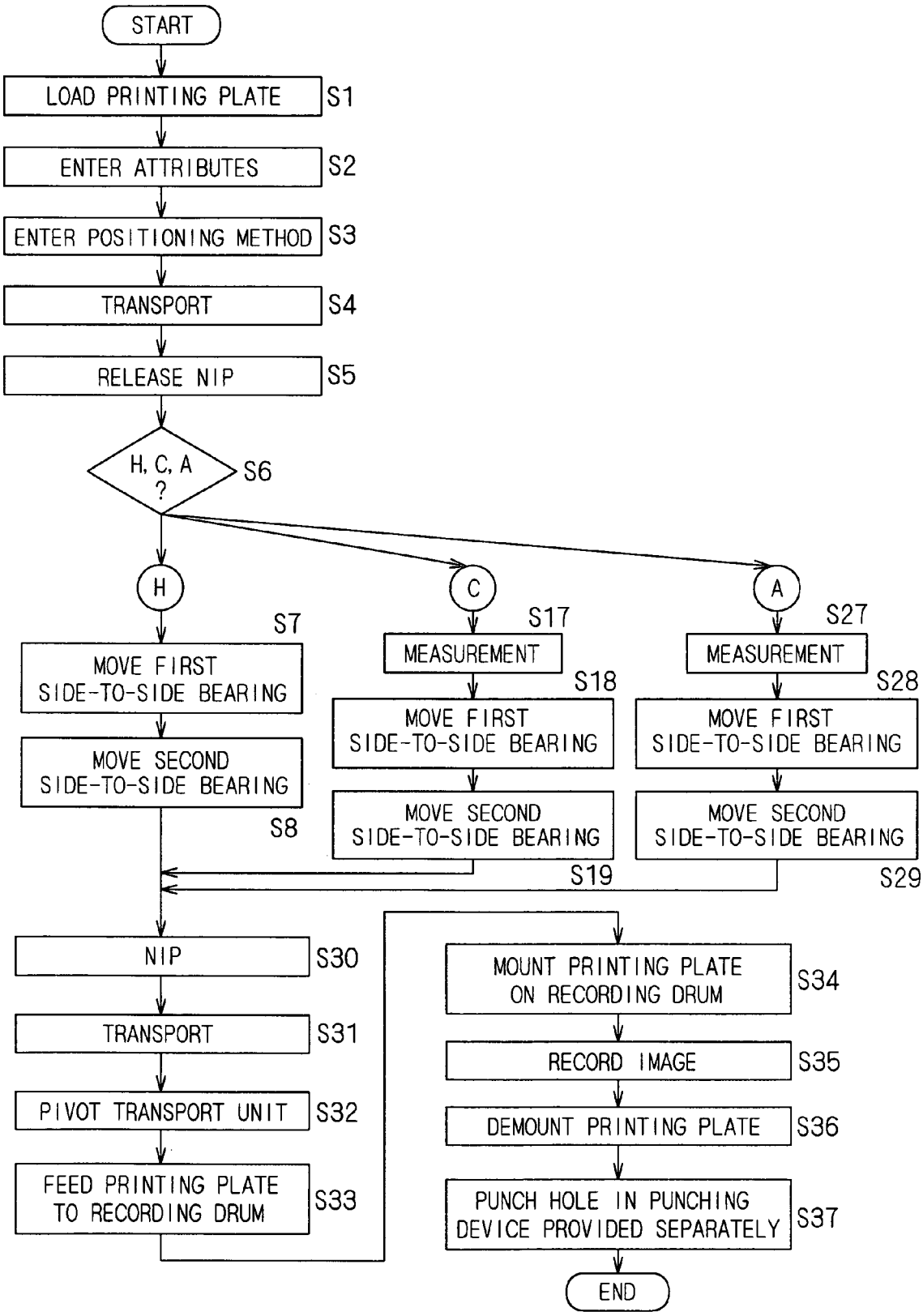
FIG. 12 is a flow chart illustrating a series of operation.

Next, a series of steps will be described referring to a flow chart shown in FIG. 12.

First, an unexposed printing plate P is loaded on the first transport path 91 of the transport unit 9 manually or by a predetermined autoloader (step S1).

Next, attributes such as an approximate width (standardized dimensions) of the loaded printing plate P are entered by an input device such as a mouse, a keyboard or the like (step S2).

Next, the positioning method to be used for punching positional holes for printing press is entered by the input device (step S3). That is, one of the home-side edge registration, the centering and the away-side edge registration as described above referring to FIGS. 6 to 8 is entered.

Then, the printing plate P is moved toward the printing-plate side-to-side adjustment unit 10 (step S4). When the leading-edge detection sensor 207 of the unit 10 detects the leading edge of the printing plate P, the transport of the printing plate P is stopped.

Next, the nip roller 963 is moved upward to release the nip of the printing plate P held between the first transport roller 943 and nip roller 963 (step S5). Then, the side-to-side adjustment of the printing plate P can be performed satisfactorily.

Next, the process is divided depending on the positioning method entered in step S3 (step S6).

First, the case in which the home-side edge registration is selected will be described.

The first side-to-side adjustment bearing 202*a* is moved until a point of the first abutment member 203*a* that is in contact with the printing plate P reaches a position being a distance of h11 away from a home-side original position H0

(step S7). Hereafter the distance h11 is referred to as a first target distance h11. The first target distance h11 will be described later.

Next, the second side-to-side adjustment bearing 202*b* is moved until a point of the second abutment member 203*b* that is in contact with the printing plate P reaches a position being a distance of a11 away from an away-side original position A0 (step S8). Hereafter the distance of a11 is referred to as a second target distance a11.

Figure 13:
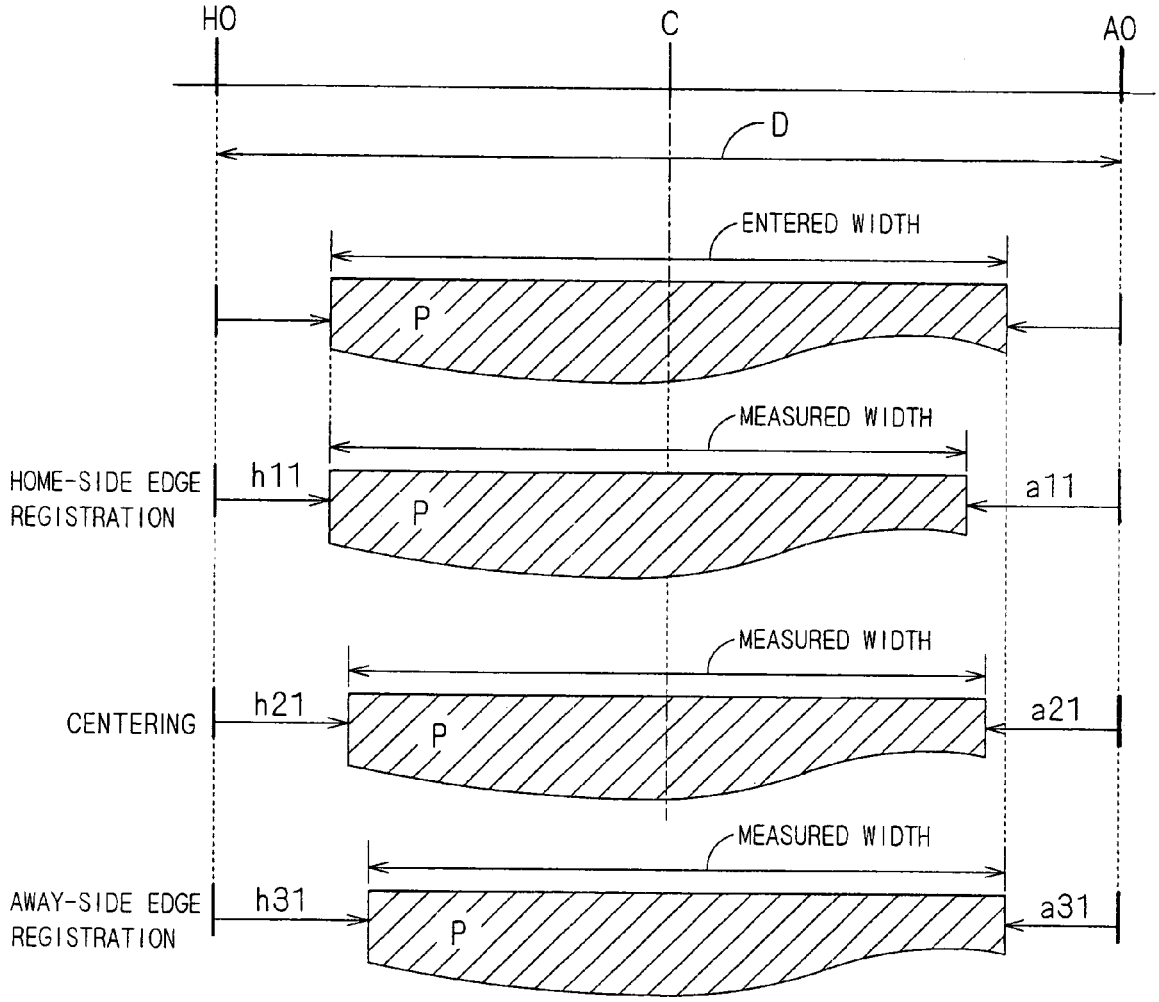
FIG. 13 is an explanatory view illustrating how to determine travel distances of the first and second side-to-side adjustment bearings.

The first target distance h11 and second target distance a11 will be described now referring to FIG. 13.

The home-side original position H0 is established in the first ball screw 204*a* of the printing-plate side-to-side adjustment unit 10, and the away-side original position A0 is established in the second ball screw 204*b*. An interval between the home-side original position H0 and away-side original position A0 shall be indicated as a distance D, and the intermediate position between the home-side original position H0 and away-side original position A0 shall be indicated as a center C. In the case of the home-side edge registration, each printing plate P is positioned such that the home-side edge is placed in a position away from the center C by half an entered width of the printing plate P regardless of a measured width of the printing plate P. Therefore, the target distance h11 for the first abutment member 203*a* in the case of the home-side edge registration is defined as follows:

$$h11 = D/2 - (\text{entered width} \times 1/2)$$

The second target distance a11 for the second abutment member 203*b* in the case of the home-side edge registration is defined as follows:

$$a11 = D/2 - (\text{entered width} \times 1/2 - \alpha)$$

The value α indicates a margin allowed for the case in which the measured width of each printing plate P is narrower than the entered width.

Next, the case in which the centering is selected in step S3 will be described now. In this case, the width of the printing plate P is measured after step S6 to obtain a measured width of the printing plate P (step S17). The width of the printing plate P is obtained by summing up a travel distance of the first side-to-side adjustment bearing 202*a* from the home-side original position H0 until the first printing-plate detection sensor 206*a* detects the home-side edge of the printing plate P and a travel distance of the second side-to-side adjustment bearing 202*b* from the away-side original position A0 until the second printing-plate detection sensor 206*b* detects the away-side edge of the printing plate P.

The first side-to-side adjustment bearing 202*a* is moved until a point of the first abutment member 203*a* that is in contact with the printing plate P reaches a position being a distance of h21 away from the home-side original position H0 (step S18). Hereafter the distance h21 is referred to as a third target distance h21. The third target distance h21 will be described later.

Next, the second side-to-side adjustment bearing 202*b* is moved until a point of the second abutment member 203*b* that is in contact with the printing plate P reaches a position being a distance of a21 away from the away-side original position A0 (step 19). Hereafter the distance a21 is referred to as a fourth target distance a21.

The third target distance h21 and fourth target distance a21 will be described now referring to FIG. 13.

In the case of the centering, each printing plate P is positioned such that an actual central position of each printing plate P coincides with the center C regardless of the entered width of the printing plate P.

Therefore, the third target distance h21 is defined as follows:

$$h21 = D/2 - (\text{measured width} \times 1/2)$$

Similarly, the fourth target distance a21 is defined as follows:

$$a21 = D/2 - (\text{measured width} \times 1/2)$$

Now, the case in which the away-side edge registration is selected in step S3 will be described. In this case, the width of the printing plate P is measured after step S6 to obtain a measured width of the printing plate P (step S27). The measurement method is similar to that employed in step S17 as described above.

Next, the first side-to-side adjustment bearing 202*a* is moved until the position of the first abutment member 203*a* that is in contact with the printing plate P reaches a position being a distance of h31 away from the home-side original position H0 (step S28). Hereafter the distance h31 is referred to as a fifth target distance h31. The fifth target distance h31 will be described later.

Next, the second side-to-side adjustment bearing 202*b* is moved until the point of the second abutment member 203*b* that is in contact with the printing plate P reaches a position being a distance of a31 away from the away-side original position A0 (step S29). Hereafter the distance h31 is referred to as a sixth target distance a31.

The fifth target distance h31 and sixth target distance a31 will be described now referring to FIG. 13.

In the case of the away-side edge registration, each printing plate P is positioned such that the away-side edge is placed in a position away from the center C by half an entered width of the printing plate P regardless of a measured width of the printing plate P. Therefore, the fifth target distance h31 for the first abutment member 203*a* in the case of the away-side edge registration is defined as follows:

$$h31 = D - \text{measured width} - (D/2 - \text{entered width}/2)$$

The sixth target distance a31 for the second abutment member 203*b* in the case of away-side edge registration is defined as follows:

$$a31 = D/2 - \text{entered width}/2$$

The reason why the home-side edge registration is also performed in the case of the away-side edge registration is because the second abutment member 203*b* is slightly slidable in this embodiment.

When the printing plate P is positioned by the printing-plate side-to-side adjustment unit 10 by either the home-side edge registration, the centering or the away-side edge registration as described above, the nip roller 963 is moved downward, so that the leading edge of the printing plate P is nipped between the nip roller 963 and first transport roller 943 (step S30).

Next, the printing plate P is returned to the transport path 91 of the transport unit 9 (step S31), and then, the transport unit 9 pivots downwardly (step S32) to supply the printing plate P toward the recording drum 1 (step S33).

The printing plate P is fixed on the outer peripheral surface of the recording drum 1 by the leading edge clamps 2 and trailing edge clamps 3 (step S34), and image recording is performed by the recording head 8 (step S35). Thereafter, the printing plate P is demounted from the recording drum 1 to be returned to the second transport path 92, and is discharged to the outside of the image recorder (step S36).

Thereafter, image recording on the printing plate P is completed, and the printing plate P is then transported by an autoloader not shown or manually to a punching device separately provided. In this punching device, the positioning of the printing plate P is carried out by the positioning method entered in step S3, and positioning holes for printing press is punched (step S37).

In the present preferred embodiment, the positioning of the printing plate P in the image recorder is carried out in accordance with the positioning method of the printing plate P when punching the positioning holes for printing press. Therefore, the problem described above referring to FIG. 11 in that the positional relationship between a recorded image and positioning holes varies in each printing plate does not arise.

In the present embodiment, the positioning holes for printing press are punched in the printing plate P after image recording is performed, however, the present invention is also applicable to the case of performing image recording on the printing plate P with the positioning holes for printing press punched therein previously.

In the present embodiment, the positioning method employed in the punching device is manually entered, however, information about the method may be entered on-line.

Further, a precise width of the printing plate P is measured based on the travel distances of the first and second side-to-side adjustment bearings 202*a* and 202*b* in the present embodiment, however, another measurement method may be used. For instance, a width detection sensor may be provided on the first transport path 91.

While the invention has been shown and described in detail, the foregoing description is in a11 aspects illustrative and not restrictive. It is therefore understood that numerous modifications and variations can be devised without departing from the scope of the invention.

What is claimed is:

1. An image recorder comprising:

a transport element for transporting a rectangular printing plate in a first direction;

a positioning element for moving said printing plate in a second direction perpendicular to said first direction, thereby positioning said printing plate in said second direction;

an image recording element for directing a light beam onto said printing plate positioned in said second direction by said positioning element, thereby recording an image on said printing plate;

a first input device for entering a reference position used for punching positioning holes for printing press in said printing plate;

a second input device for entering an approximate width of said printing plate;

a measuring element for obtaining a measured width of said printing plate;

a first transport member having fixed thereto a first abutment member to be in contact with one edge of said printing plate;

a second transport member having a second abutment member to be in contact with the other edge of said printing plate, said second abutment member being slightly movable in said second direction; and a motor for moving said first transport member and said second transport member individually in said second direction, wherein (i) when said first input device enters said one edge of said printing plate as a reference position, a first reference position on the side of said one edge and a second reference position on the side of said other edge are calculated on the basis of said approximate width, (ii) when said first input device enters a central position of said printing plate in said second direction as a reference position, said first reference position on the side of said one edge and said second reference position on the side of said other edge are calculated on the basis of said measured width, (iii) when said first input device enters said other edge as a reference position, said first reference position on the side of said one edge is calculated on the basis of said approximate width and said measured width while said second reference position on the side of said other edge is calculated on the basis of said approximate width, and said motor moves said first transport member such that said first abutment member reaches said first reference position and moves said second transport member such that said second abutment member reaches said second reference position.

2. The image recorder according to claim 1, wherein a first sensor for detecting said one edge of said printing plate is provided for said first transport member, a second sensor for detecting said other edge of said printing plate is provided for said second transport member, and said measured width is determined on the basis of the position of said first transport member at which said first sensor detects said one edge of said printing plate and the position at which said second sensor detects said other edge of said printing plate.

3. The image recorder according to claim 2, further comprising a punching element for punching positioning holes for printing press in said printing plate positioned in said second direction by said positioning element.

4. A method of recording an image on a rectangular printing plate, comprising the steps of:

(a) transporting said printing plate in a first direction;

(b) specifying a position of said printing plate to be used as a reference for positioning in a second direction perpendicular to said first direction;

(c) entering an approximate width of said printing plate;

(d) obtaining a measured width of said printing plate;

(e) calculating a first reference position on the side of one edge of said printing plate and a second reference position on the side of the other edge of said printing plate with reference to the position specified in said step (b);

(f) positioning said printing plate in said second direction on the basis of said first reference position and said second reference position;

(g) directing a light beam onto said printing plate positioned in said step (f), thereby recording an image on said printing plate, wherein one of the following (i) to (iii) is specified in said step (b):

(i) one edge of said printing plate almost parallel to said first direction;

(ii) the other edge of said printing plate almost parallel to said first direction; and (iii) a central position of said printing plate in said second direction, when said (i) is specified, said first reference position and said second reference position are calculated on the basis of said approximate width in said step (c), when said (ii) is specified, said first reference position and said second reference position are calculated on the basis of said measured width in said step (e), and when said (iii) is specified, said first reference position is calculated on the basis of said approximate width and said measured width while said second reference position is calculated on the basis of said approximate width in said step (e).

5. The method according to claim 4, further comprising the step of (h) punching positioning holes for printing press in said printing plate positioned in said step (f).

* * * * *